US008584659B2

(12) United States Patent
Livingston

(10) Patent No.: US 8,584,659 B2
(45) **Date of Patent: *Nov. 19, 2013**

(54) ULTRASONIC FUEL AND POWER ENHANCER AND METHOD

(76) Inventor: Kenneth Livingston, Ontario, CA (US)

( * ) Notice: Subject to any disclaimer, the term of this patent is extended or adjusted under 35 U.S.C. 154(b) by 149 days.

This patent is subject to a terminal disclaimer.

(21) Appl. No.: 13/098,979

(22) Filed: May 2, 2011

(65) Prior Publication Data

US 2012/0060802 A1 Mar. 15, 2012

Related U.S. Application Data

(63) Continuation of application No. PCT/US2008/082206, filed on Nov. 3, 2008.

(51) Int. Cl.
*F02M 29/00* (2006.01)

(52) U.S. Cl.
USPC ..... 123/590

(58) Field of Classification Search
USPC ..... 123/590–593
See application file for complete search history.

(56) References Cited

U.S. PATENT DOCUMENTS

| | | | | |
|---|---|---|---|---|
| 2,745,372 A | | 5/1956 | Chertoff | |
| 2,925,257 A | | 2/1960 | Cahn | |
| 3,815,565 A | | 6/1974 | Stelter | |
| 3,857,375 A | * | 12/1974 | Jackson | 123/587 |
| 3,914,353 A | | 10/1975 | Cherry | |
| 4,148,285 A | * | 4/1979 | Ahlers | 48/189.3 |
| 4,628,890 A | * | 12/1986 | Freeman | 123/593 |
| 6,371,095 B1 | * | 4/2002 | Sacarto | 123/590 |
| 6,550,446 B1 | | 4/2003 | Robley, Jr. | |
| 7,267,098 B1 | | 9/2007 | Tasanont | |
| 7,445,000 B1 | * | 11/2008 | Livingston | 123/593 |
| 7,909,027 B2 | * | 3/2011 | Livingston | 123/590 |

OTHER PUBLICATIONS

PCT/US2008/082206, Intl. Search Report & Written Opinion, Jan. 21, 2009, Livingston.

* cited by examiner

*Primary Examiner* — M. McMahon
(74) *Attorney, Agent, or Firm* — John J. Connors; Connors & Assoc. pc

(57) ABSTRACT

An ultrasonic fuel/power enhancer for producing sound and ultrasound at different wind speeds and conditions is provided. The enhancer is mountable in an air intake of a vehicle with the vehicle having a predetermined number of cylinders and each cylinder having a combustion chamber. The enhancer comprises at least one band and at least one tubular whistle. A whistle connection mechanism is wrapped around the whistle with the whistle connection mechanism having at least one band receiving aperture and the band insertable through one of the band receiving apertures. At least one stabilizing tab is mounted to the whistle connection mechanism wherein the whistle is shaped and designed to produce sonic and ultrasonic sounds thereby atomizing gas droplets being supplied to the combustion chamber of each cylinder.

6 Claims, 6 Drawing Sheets

ULTRASONIC FUEL AND POWER ENHANCER AND METHOD

RELATED PATENT APPLICATIONS & INCORPORATION BY REFERENCE

This is a National Stage continuation utility patent application which claims the benefit of International Application No. PCT/US 2008/082206, entitled "ULTRASONIC FUEL/POWER ENHANCER," filed Nov. 3, 2008. This related application is incorporated herein by reference and made a part of this application. Moreover, any and all U.S. patents, U.S. patent applications, and other documents, hard copy or electronic, cited or referred to in this application are incorporated herein by reference and made a part of this application.

BACKGROUND OF THE INVENTION

1. Field of the Invention

This invention relates generally to an ultrasonic fuel/power enhancer and, more particularly, the invention relates to an ultrasonic fuel/power enhancer having an array of whistles producing sound and ultrasound at different wind speeds and conditions.

2. Description of the Prior Art

While many U.S. consumers complain about high gasoline prices, they are not buying less gasoline. That, in turn, maintains the high gasoline prices. The Energy Information Administration, the analytical arm of the Energy Department, predicts that even if crude oil prices decline over the next few months, retail gasoline prices will probably stay high. Because of changes in American's driving habits over the last decade, the demand for gasoline changes little, even when prices climb. The vehicles that many people are driving, most notably sport-utility vehicles and light trucks, get far lower gas mileage than cars did twenty years ago. In roughly the same period, the number of drivers has increased overall, as has the number of miles people drive each year. Even if OPEC, the oil cartel, continued to produce oil at the current rate and does not introduce any prices increases, motorists can expect gasoline prices to remain high as refiners, in general, have been keeping inventories low to cut costs.

SUMMARY

The present invention is an ultrasonic fuel/power enhancer for producing sound and ultrasound at different wind speeds and conditions. The enhancer is mountable in an air intake of a vehicle with the vehicle having a predetermined number of cylinders and each cylinder having a combustion chamber. The enhancer comprises at least one band and at least one tubular whistle. A whistle connection mechanism mounts the whistle to the band wherein the whistle is shaped and designed to produce sonic and ultrasonic sounds thereby atomizing gas droplets being supplied to the combustion chamber of each cylinder.

In addition, the present invention includes an ultrasonic fuel/power enhancer for producing sound and ultrasound at different wind speeds and conditions is provided. The enhancer is mountable in an air intake of a vehicle with the vehicle having a predetermined number of cylinders and each cylinder having a combustion chamber. The enhancer comprises at least one band and at least one tubular whistle. A whistle connection mechanism is wrapped around the whistle with the whistle connection mechanism having at least one band receiving aperture and the band insertable through one of the band receiving apertures. At least one stabilizing tab is mounted to the whistle connection mechanism wherein the whistle is shaped and designed to produce sonic and ultrasonic sounds thereby atomizing gas droplets being supplied to the combustion chamber of each cylinder.

The present invention further includes a method for producing sound and ultrasound at different wind speeds and conditions. The method comprises providing a vehicle having an air intake of a vehicle, a predetermined number of cylinders, and a combustion chamber associated with each cylinder, providing at least one band constructed of a bendable material, mounting at least one tubular whistle to the band, mounting the combined band and whistle within the air intake, producing sonic and ultrasonic sounds, and atomizing gas droplets being supplied to the combustion chamber of each cylinder.

DETAILED DESCRIPTION OF THE PREFERRED EMBODIMENTS

Figure 1:
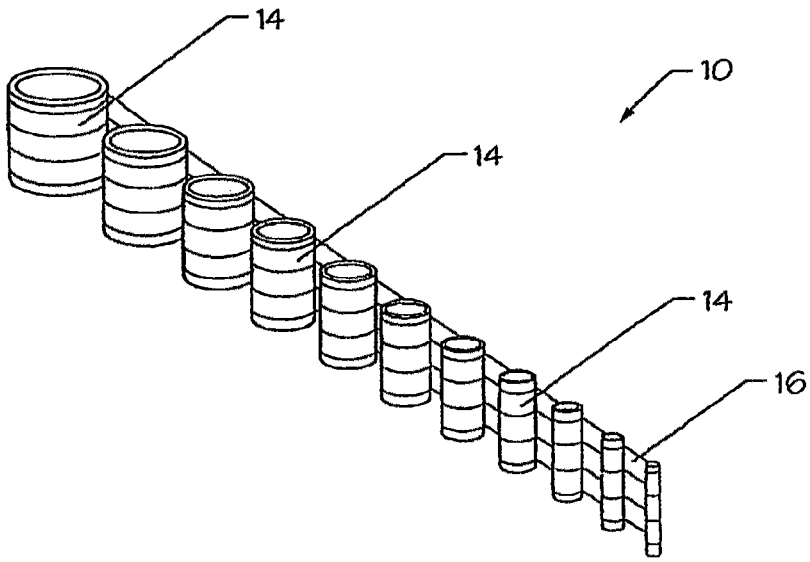
FIG. 1 is a perspective view illustrating an ultrasonic fuel/power enhancer, constructed in accordance with the present invention.
Figure 2:
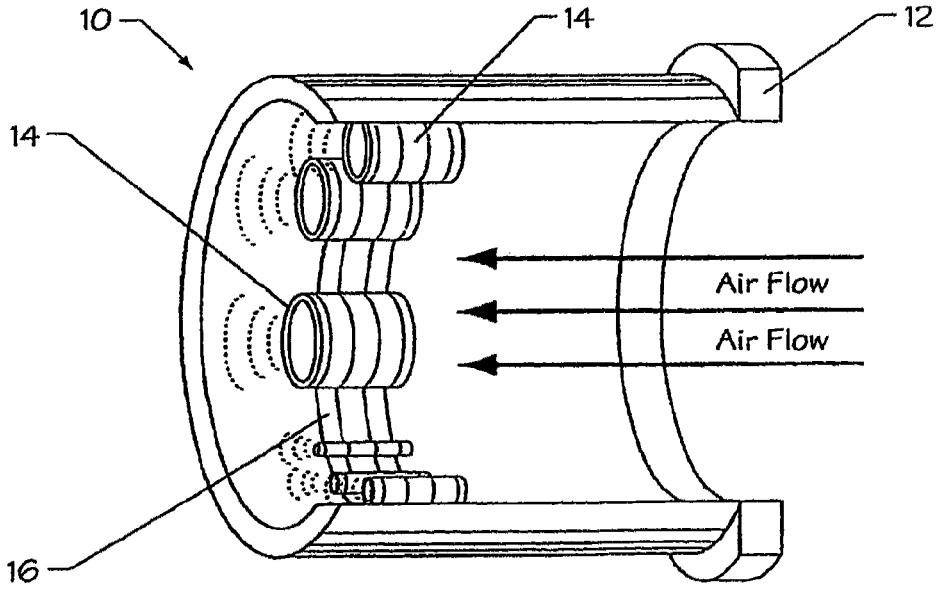
FIG. 2 is a perspective cut-away view illustrating the ultrasonic fuel/power enhancer, constructed in accordance with the present invention, with the enhancer mounted within a tube-type air intake.
Figure 3:
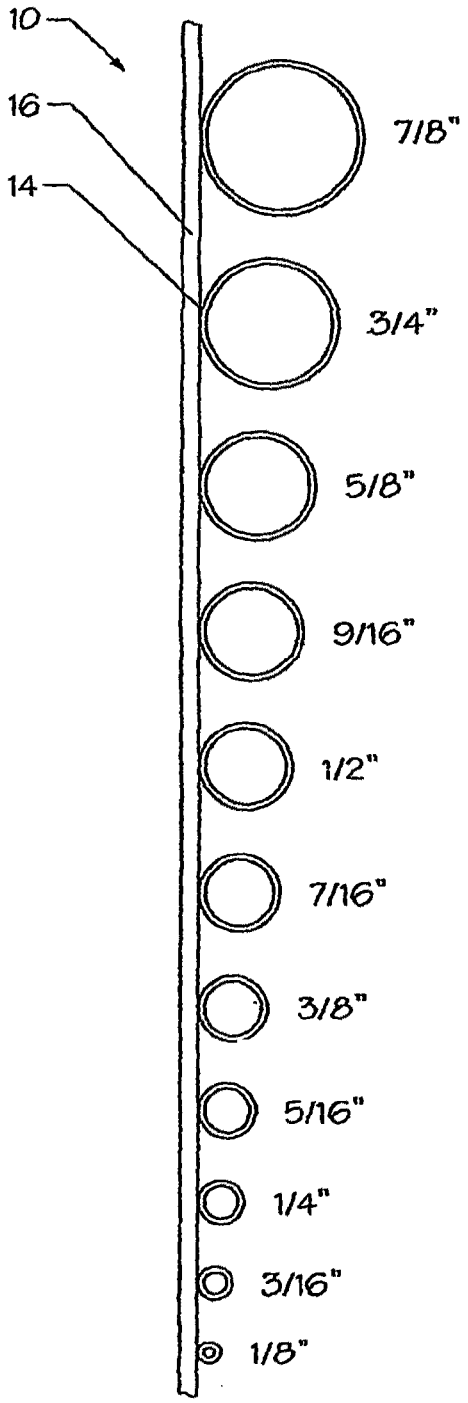
FIG. 3 is an elevational side view illustrating the ultrasonic fuel/power enhancer, constructed in accordance with the present invention.
Figure 4:
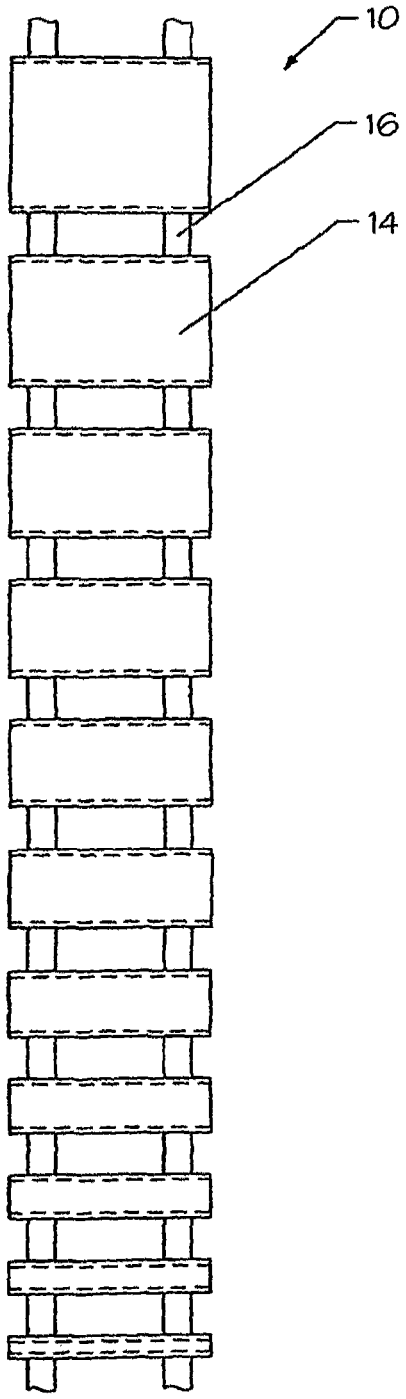
FIG. 4 is a front view illustrating the ultrasonic fuel/power enhancer, constructed in accordance with the present invention.
Figure 5:
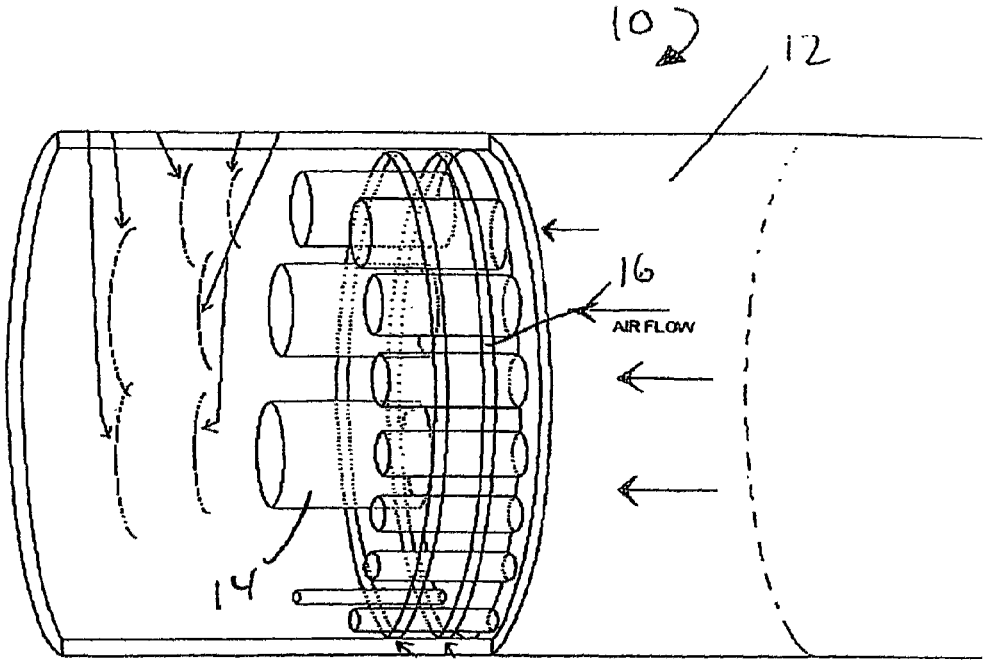
FIG. 5 is a perspective cut-away view illustrating the ultrasonic fuel/power enhancer, constructed in accordance with the present invention, with sound waves emitting from the whistles.

As illustrated in FIGS. 1-10, the present invention is an ultrasonic fuel/power enhancer, indicated generally at 10, for producing sound and ultrasound at different wind speeds and conditions. The ultrasonic fuel/power enhancer 10 is an engine accessory device for automotive vehicles mountable in the air intake 12 of the vehicle (not shown). Preferably, the ultrasonic fuel/power enhancer 10 is constructed from a heat resistant, rust resistant metal material.

The ultrasonic fuel/power enhancer 10 of the present invention includes an array of individual tubular whistles 14 positioned in an incremental manner on at least one band 16. Each whistle 14 is preferably a straight hollow tube creating an ultrasonic sound as air passes through the whistle 14. In addition, in a preferred embodiment, the ultrasonic fuel/power enhancer 10 includes a pair of individual bands 16 in spaced relation to each other although having more bands 16 is within the scope of the present invention.

Figure 6:
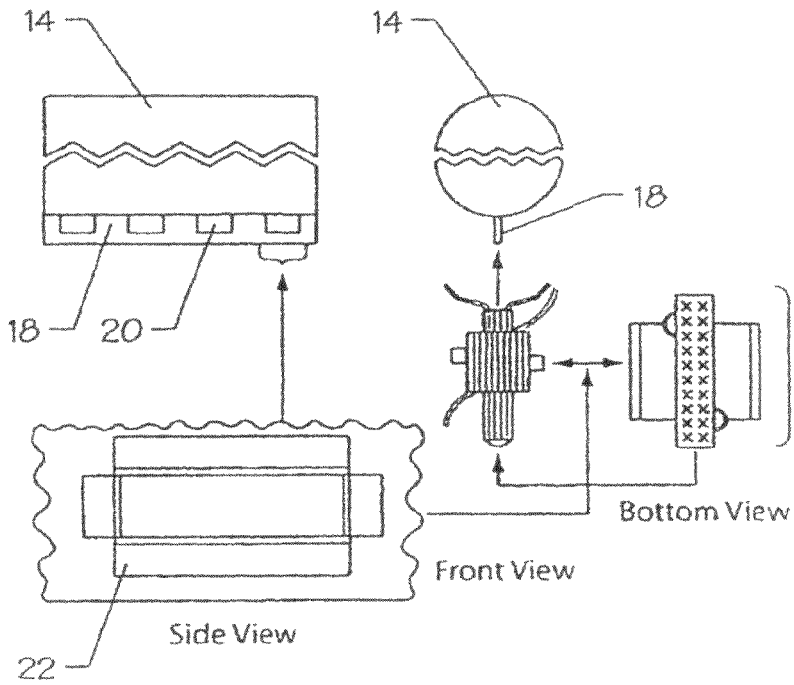
FIG. 6 is various views illustrating an embodiment of the whistle connection mechanism of the ultrasonic fuel/power enhancer, constructed in accordance with the present invention.
Figure 7:
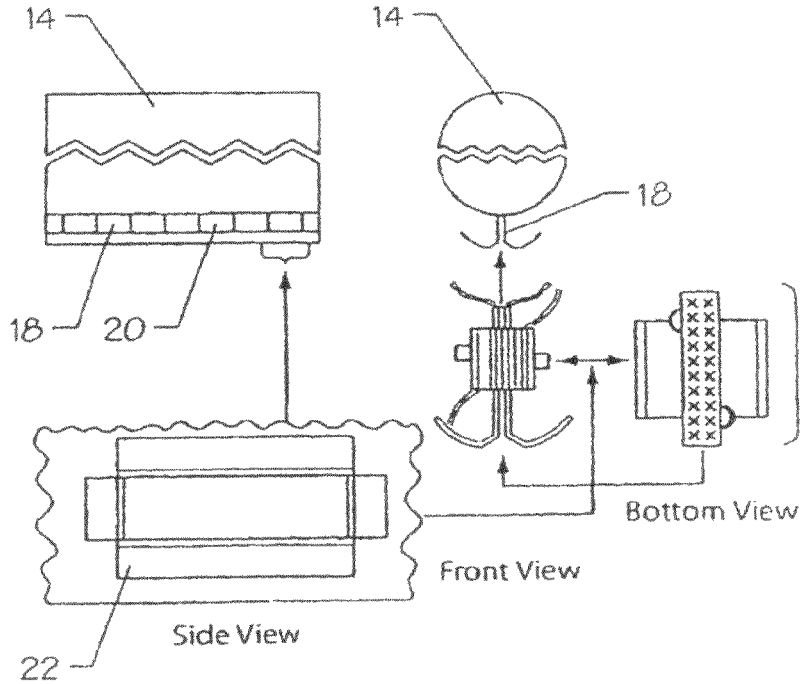
FIG. 7 is various views illustrating another embodiment of the whistle connection mechanism of the ultrasonic fuel/power enhancer, constructed in accordance with the present invention.

As best illustrated in FIGS. 6 and 7, the whistles 14 of the ultrasonic fuel/power enhancer 10 of the present invention are secured to the bands 16 by a whistle connection mechanism 18 wrapped around each individual whistle 14. Each of the whistle connection mechanisms 18 includes a plurality of band receiving apertures 20. By providing a plurality of band receiving apertures 20, the user can determine how many bands 16 are used and the position of each of the bands 16 relative to the whistles 14, depending on the desires of the user and the size of the air intake 12 of the vehicle.

In addition, each of the whistle connection mechanisms 18 of the ultrasonic fuel/power enhancer 10 of the present invention have stabilizing tabs 22 to maintain the whistles 14 from moving relative to the bands 16. The stabilizing tabs 22 inhibit metal fatigue and insure that the whistles 14 are in a tight, but movable position relative to the bands 16.

Preferably, the whistles 14 of the ultrasonic fuel/power enhancer 10 are aligned along the length of the bands 16 in a linear fashion graduating progressively from the smallest whistle to the largest whistle. The inside diameters of the whistles 14 used can vary in one-eight (⅛") inch increments from one-eighth (⅛") inch (the smallest) to seven-eighths (⅞") inch (the largest) for a total of eleven (11) whistles 14. In addition, the length of each of the whistles 14 can vary and is only limited by the amount of space within the air intake 12 of the vehicle. In a preferred embodiment, the length of each of the whistles 14 is between one-half (½") inch and two (2") inches. It should be noted that while particular inside diameters, lengths, and number of whistles 14 have been described an illustrated herein, it is within the scope of the present invention to have different sized whistles 14 and to have the total number of whistles 14 be less than or greater than eleven (11). Furthermore, while the whistles 14 have been described as being mounted to the bands 14 from smallest whistle to largest whistle, it is within the scope of the present invention to mount the whistles 14 to the bands 16 in any desired or random order.

In short, the sizes and configuration of the whistles 14 are shaped and designed to produce sonic and ultrasonic sounds thereby atomizing gas droplets being supplied to the combustion chamber of each cylinder. Basically, having different sized whistles 14 adjusting to different airflow conditions (i.e.: wind speed, humidity air pressure temperature etc.) is key. Furthermore, the sizes and configuration of the whistles 14 can be adjusted to a vortex mode if desired. Actual operation of the ultrasonic/fuel power enhancer 10 will be described in further detail below.

As stated above, the whistles 14 of the ultrasonic fuel/power enhancer 10 of the present invention are secured to a pair of spaced bands 16. The bands 16 are preferably constructed from a bendable metal material such as aluminum, copper, or brass, although constructing the bands 16 from other bendable metal materials, or even plastics, are within the scope of the present invention. By mounting the whistles 14 to the bendable metal bands 16, the whistles 14 are linked together in a circular manner when installed in the air intake 12 of the vehicle.

Figure 8:
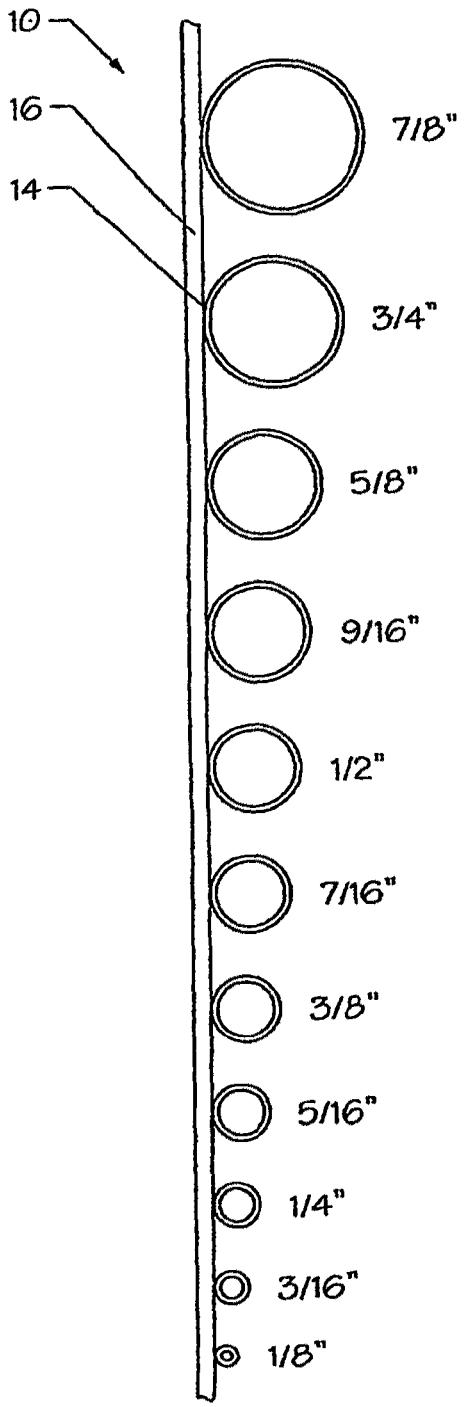
FIG. 8 is an elevational side view illustrating another embodiment of the ultrasonic fuel/power enhancer, constructed in accordance with the present invention.
Figure 9:
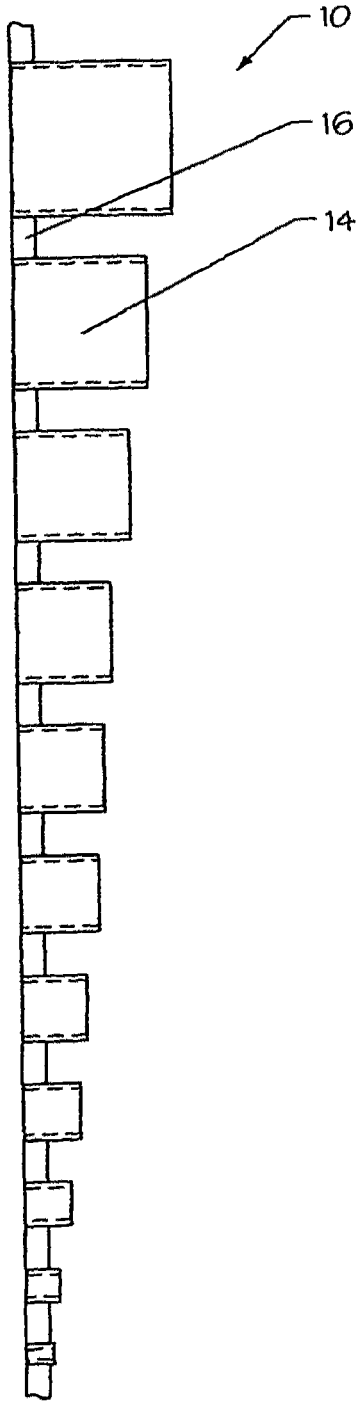
FIG. 9 is a front view illustrating the ultrasonic fuel/power enhancer of FIG. 8, constructed in accordance with the present invention.
Figure 10:
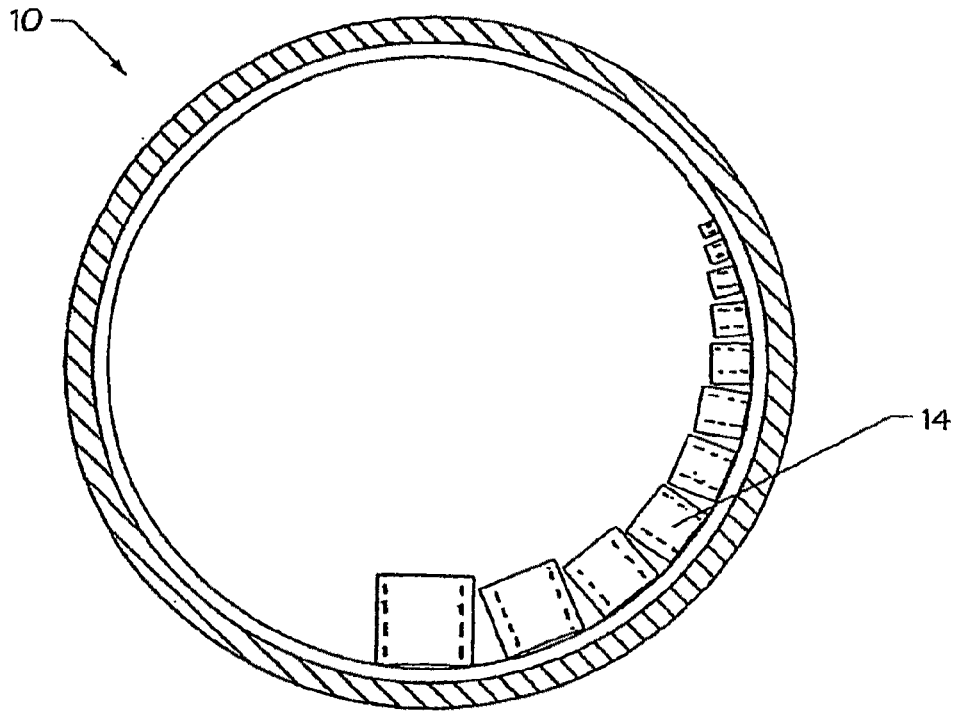
FIG. 10 is a perspective cut-away view illustrating the ultrasonic fuel/power enhancer of FIG. 8, constructed in accordance with the present invention, with ultrasonic fuel/power enhancer mounted between the air filter and the manifold intake.

In another embodiment of the ultrasonic fuel/power enhancer 10 of the present invention, as illustrated in FIGS. 8-10, the whistles 14 are arranged such that the air flow travels from the side over the top of the whistles 14 rather than directly through the whistles 14. The air flow over the top of the whistles 14 creates the required sound and ultrasound noises.

The ultrasonic fuel/power enhancer 10 of the present invention is used in conjunction with throttle body, fuel injection systems within vehicles. This type of fuel injection system operates similar to a carburetor type system with one or two injectors sitting atop a conventional intake manifold. It should be noted that the ultrasonic fuel/power enhancer 10 is also operational in vehicles having a carburetor system. It should also be noted that the ultrasonic fuel/power enhancer 10 of the present invention can be utilized in gasoline or alcohol powered engines mounted to a stationary object. In this instance, with constant wind velocity, only a single whistle 14 is required to produce the sound and ultrasound whistle noises.

The ultrasonic fuel/power enhancer 10 is formed into a substantially round configuration and positioned in a press-fit manner between the air filter and the throttle intake manifold. The sonic and ultrasonic sounds produced by the whistles 14 of the ultrasonic fuel/power enhancer 10 atomizes the gasoline droplets fed into the intake manifold which are then mixed with air in the manifold and sent to the individual cylinders via the manifold's runners. The atomized fuel is easier to ignite in the combustion chamber, allowing for optimal burning of the gasoline. Basically, the ultrasonic fuel/power enhancer 10 is an affordable and effective way to increase the efficiency of an engine and improve performance, benefits which would be most attractive to the general motoring populace.

It should be noted that it is within the scope of the present invention for the ultrasonic fuel/power enhancer 10 of the present invention to be constructed in a fixed version mimicking the variety and variableness of the adjustable versions described above. It should also be noted that it is within the scope of the present invention for the ultrasonic fuel/power enhancer 10 of the present invention to be constructed in other shapes and sizes producing the sound and ultrasound whistle noises. For example, a formed hollow depression can be formed rather than a tubular whistle. The key is the array that automatically adjusts to the variable wind velocities. The tubular whistle is a preferred embodiment due to the readily available material and the cost of construction. Metal or plastic molded tubes are within the scope of the present invention.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An ultrasonic fuel/power enhancer that produces sound and ultrasound at different wind speeds and conditions to atomized fuel, said enhancer comprising means for attaching the enhancer to the intake of an engine, and an array of tubular whistles mounted to the attaching means such that air flow through the whistles is substantially parallel to air flow through the intake so that air flows through the whistles as air flows into the intake, at least some of the whistles having a different inside diameters.

2. The enhancer of claim 1 where the tubular whistles are positioned to provide a vortex mode.

3. The enhancer of claim 1 where the tubular whistles are positioned in a random order.

4. The enhancer of claim 1 where the individual tubular whistles are aligned along the attaching means in a linear fashion graduating progressively from the smallest diameter whistle to the largest whistle.

5. The enhancer of claim 1 where the tubular whistles have inside diameters substantially from one-eight (⅛") inch to seven-eighths (⅞") inch.

6. The enhancer of claim 1 where the tubular whistles have a length substantially from one-half (½") inch and two (2") inches.

* * * * *